US011353901B2

(12) United States Patent
Chauhan et al.

(10) Patent No.: US 11,353,901 B2
(45) Date of Patent: Jun. 7, 2022

(54) VOLTAGE THRESHOLD GAP CIRCUITS WITH TEMPERATURE TRIM

(71) Applicant: TEXAS INSTRUMENTS INCORPORATED, Dallas, TX (US)

(72) Inventors: Rajat Chauhan, Bengaluru (IN); Joseph Alan Sankman, Dallas, TX (US); Avinash Shreepathi Bhat, Tucson, AZ (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 35 days.

(21) Appl. No.: 17/097,988

(22) Filed: Nov. 13, 2020

(65) Prior Publication Data

US 2021/0149424 A1 May 20, 2021

Related U.S. Application Data

(60) Provisional application No. 62/935,962, filed on Nov. 15, 2019.

(51) Int. Cl.

| | |
|---|---|
| ***G05F 1/46*** | (2006.01) |
| ***G05F 3/26*** | (2006.01) |
| ***G05F 1/565*** | (2006.01) |

(52) U.S. Cl.

CPC ..... *G05F 1/468* (2013.01); *G05F 1/565* (2013.01); *G05F 3/262* (2013.01)

(58) Field of Classification Search

CPC ..... G05F 1/468; G05F 1/565; G05F 3/262
See application file for complete search history.

(56) References Cited

U.S. PATENT DOCUMENTS

| | | | | |
|---|---|---|---|---|
| 5,311,115 | A | 5/1994 | Archer | |
| 5,541,539 | A * | 7/1996 | Schlachter | H03K 17/14 327/391 |
| 6,465,998 | B2 | 10/2002 | Sirito-Olivier | |
| 7,342,439 | B2 | 3/2008 | Hsiao | |
| 7,978,005 | B1 | 7/2011 | Hyde et al. | |
| 8,031,020 | B1 * | 10/2011 | Tu | H03B 5/1265 331/117 FE |
| 9,952,617 | B1 | 4/2018 | Gupta et al. | |
| 10,432,192 | B1 | 10/2019 | Kaur et al. | |

(Continued)

OTHER PUBLICATIONS

Sharroush, et al, Subthreshold MOSFET Transistor Amplifier Question, 978-1-4244-5750-2/10. IEEE 2009, 6 pages.

(Continued)

*Primary Examiner* — Kyle J Moody
*Assistant Examiner* — Lakaisha Jackson
(74) *Attorney, Agent, or Firm* — Michael A. Davis, Jr.; Charles A. Brill; Frank D. Cimino

(57) ABSTRACT

An electronic circuit includes a first transistor, a second transistor, and a variable resistor. The first transistor has a first threshold voltage. The second transistor has a second threshold voltage that is different from the first threshold voltage. The second transistor is coupled to the first transistor. The variable resistor is coupled to the first transistor and the second transistor. The variable resistor is configured to adjust a temperature coefficient of the electronic circuit. The electronic circuit is configured to generate a reference voltage based on a difference of the first threshold voltage and the second threshold voltage.

24 Claims, 7 Drawing Sheets

(56) References Cited

U.S. PATENT DOCUMENTS

| | | | | |
|---|---|---|---|---|
| 2003/0011351 | A1* | 1/2003 | Shim | G05F 3/245 323/316 |
| 2004/0017248 | A1 | 1/2004 | Ishida et al. | |
| 2009/0027086 | A1* | 1/2009 | Trifonov | H03K 5/088 327/66 |
| 2010/0225332 | A1* | 9/2010 | Niwa | H03K 17/9547 324/652 |
| 2012/0256613 | A1 | 10/2012 | Bellaouar et al. | |
| 2013/0076410 | A1 | 3/2013 | Chen | |
| 2019/0187739 | A1 | 6/2019 | Sugiura et al. | |
| 2020/0019202 | A1 | 1/2020 | Kaur et al. | |
| 2020/0336141 | A1* | 10/2020 | S | H03K 3/023 |

OTHER PUBLICATIONS

Yongda, et al., Threshold-voltage-difference-based CMOS voltage reference derived from basic current bias generator with 4.3 ppm/° C. temperature coefficient, Electronics Letters, Mar. 27, 2014, vol. 50, No. 7, pp. 505-507.

Peressini, et al., "Threshold Adjustment of N-Channel Enhancement Mode FETs by ION Implantation," IBM System Products Division, Hopewell Junction, New York, 2 pages.

* cited by examiner

VOLTAGE THRESHOLD GAP CIRCUITS WITH TEMPERATURE TRIM

CROSS-REFERENCE TO RELATED APPLICATIONS

The present application claims priority to U.S. Provisional Patent Application No. 62/935,962, filed Nov. 15, 2019, entitled "Reference Voltage Generator with Temperature Coefficient Trim," which is hereby incorporated herein by reference in its entirety.

BACKGROUND

Reference voltage generation circuits are employed in many applications to generate a known voltage. Voltage supervisors are one example a circuit that includes reference voltage generation. Voltage supervisors detect over-voltage or under-voltage conditions of a power supply. In one example, the power supply for a mobile device is a battery that is monitored by the voltage supervisor to detect low battery conditions. If the battery voltage drops below a given threshold, the voltage supervisor can detect the condition by comparing the battery voltage to a reference voltage. The voltage supervisor can then signal the processing elements in the mobile device to alert the user and if the battery voltage is too low, can initiate an orderly shutdown of the mobile device,

SUMMARY

Electronic circuits that produce a reference voltage based on the threshold difference of two transistors, and include temperature coefficient trimming are disclosed herein. In one example, an electronic circuit includes a comparator circuit. The comparator circuit includes a first input, a second input, a reference voltage input; a first transistor, a second transistor, and a variable resistor. The first transistor has a first threshold voltage, and includes a first terminal and a second terminal. The first terminal of the first transistor is coupled to the first input. The second transistor has a second threshold voltage that is different from the first threshold voltage, and includes a first terminal and a second terminal. The first terminal of the second transistor is coupled to the second input. The second terminal of the second transistor is coupled to the second terminal of the first transistor. The variable resistor includes a first terminal coupled to the second terminal of the second transistor, a second terminal coupled to the reference voltage input, and a third terminal coupled to the first terminal of the second transistor.

In another example, an electronic circuit includes a power supply input, a reference voltage input, a first transistor, a second transistor, and a variable resistor. The first transistor has a first threshold voltage, and includes a first terminal and a second terminal. The first terminal is coupled to the power supply input. The second transistor has a second threshold voltage that is different from the first threshold voltage. The second transistor includes a first terminal, and a second terminal coupled to the reference voltage input. The variable resistor includes a first terminal coupled to the second terminal of the first transistor, and a second terminal coupled to the first terminal of the second transistor.

In a further example, an electronic circuit includes a power supply input, a reference voltage input, a first transistor, a second transistor, and a variable resistor. The first transistor has a first threshold voltage, and includes a first terminal, a second terminal, and a third terminal. The first terminal is coupled to the power supply input. The second transistor has a second threshold voltage that is different from the first threshold voltage, and includes a first terminal and a second terminal. The first terminal of the second transistor is coupled to the second terminal of the first transistor and the third terminal of the first transistor. The variable resistor includes a first terminal coupled to the second terminal of the second transistor and a second terminal coupled to the reference voltage input.

In a yet further example, an electronic circuit includes a first transistor, a second transistor, and a variable resistor. The first transistor has a first threshold voltage. The second transistor has a second threshold voltage that is different from the first threshold voltage. The second transistor is coupled to the first transistor. The variable resistor is coupled to the first transistor and the second transistor. The variable resistor is configured to adjust a temperature coefficient of the electronic circuit. The electronic circuit is configured to generate a reference voltage based on a difference of the first threshold voltage and the second threshold voltage.

BRIEF DESCRIPTION OF THE DRAWINGS

For a detailed description of various examples, reference will now be made to the accompanying drawings in which.

DETAILED DESCRIPTION

In this description, the term "couple" or "couples" means either an indirect or direct wired or wireless connection. Thus, if a first device couples to a second device, that connection may be through a direct connection or through an indirect connection via other devices and connections. Also, in this description, the recitation "based on" means "based at least in part on." Therefore, if X is based on Y, then X may be a function of Y and any number of other factors.

Figure 1:
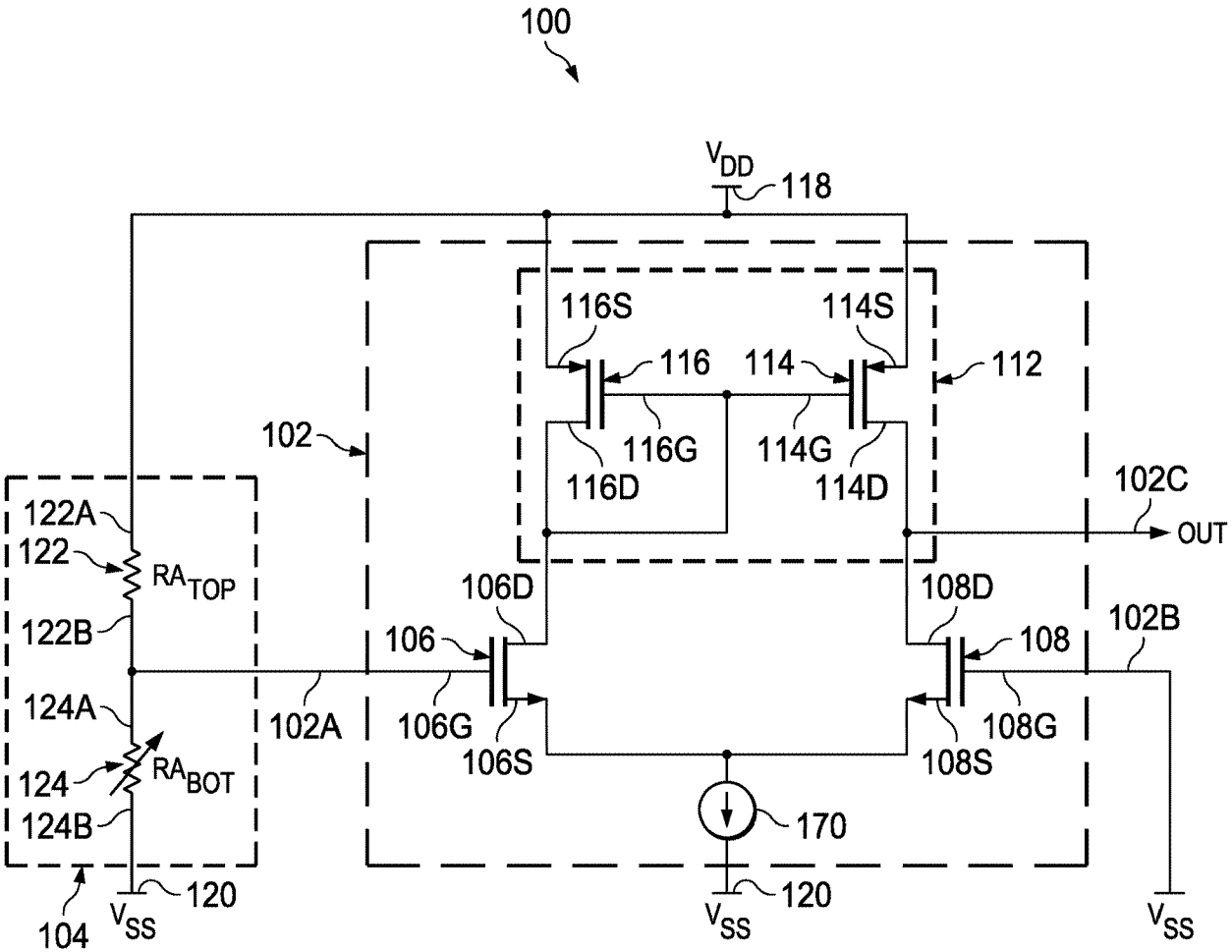
FIG. 1 shows an example power supply voltage supervisor circuit that includes a trip point based on a difference of threshold voltage of two transistors.

FIG. 1 shows an example power supply voltage supervisor circuit 100 that includes a trip point based on a difference of threshold voltages of two transistors. The power supply voltage supervisor circuit 100 includes a comparator 102, and a voltage divider 104. The voltage divider 104 divides the voltage provided on the power supply terminal 118 down to a voltage to be provided to the comparator 102. The voltage divider 104 includes a fixed resistor 122 and a variable resistor 124. A terminal 122A of the resistor 122 is coupled to the power supply terminal 118, and a terminal 122B of the resistor 122 is coupled to a terminal 124A of the variable resistor 124. A terminal 124B of the resistor 124 is coupled to a reference voltage terminal 120 (e.g., a ground terminal).

The comparator 102 includes an input terminal 102A, an input terminal 102B, a transistor 106, a transistor 108, a current source 110, and a current mirror circuit 112. The input terminal 102A is coupled to the second terminal of the resistor 122 for receipt of the divided power supply voltage. The input terminal 102B is coupled to the reference voltage terminal 120 in some implementations. The current mirror circuit 112 includes a diode-connected transistor 116 and a transistor 114. The diode-connected transistor 116 and the transistor 114 may be PMOS transistors. The diode-connected transistor 116 includes a source terminal 116S coupled to the power supply terminal 118, and a gate terminal 116G coupled to a drain terminal 116D. The transistor 114 includes a source terminal 114S coupled to the power supply terminal 118, a gate terminal 114G coupled to the gate terminal 116G of the diode-connected transistor 116, and a drain terminal 114D coupled to an output terminal 102C of the comparator 102. While transistors are shown as PMOS transistors, in alternative implementations they can be implemented with NMOS transistors or bipolar junction transistors (such as NPN or PNP transistors).

The transistor 106 includes a gate terminal 106G coupled to the input terminal 102A, a drain terminal 106D coupled to the drain terminal 116D of the diode-connected transistor 116, and a source terminal 106S coupled to the current source 110. The transistor 108 includes a gate terminal 108G coupled to the input terminal 102B, a drain terminal 108D coupled to the drain terminal 114D of the transistor 114, and a source terminal 108S coupled to the current source 110. The current source 110 maintains a fixed bias current in the comparator 102 so that the current in the comparator 102 does not vary with comparator input voltage (e.g., voltage at the input terminal 102A).

The transistor 106 is a low threshold voltage N-channel metal oxide semiconductor field effect transistor (MOSFET) in some implementations of the power supply voltage supervisor circuit 100. A low threshold voltage N-channel MOSFET has a threshold of about 0.45 volts. The transistor 108 is natural N-channel MOSFET. A natural MOSFET has a threshold of about −60 millivolts. Additional examples of the transistors 106 and 108 are provided in Table 1.

TABLE 1

| Implementation | Transistor 106 | Transistor 108 |
|---|---|---|
| 1 | Standard threshold voltage NMOS | Natural threshold voltage NMOS |
| 2 | Low threshold voltage NMOS | Natural threshold voltage NMOS |

TABLE 1-continued

| Implementation | Transistor 106 | Transistor 108 |
|---|---|---|
| 3 | Standard threshold voltage NMOS | Depletion mode NMOS |
| 4 | Low threshold voltage NMOS | Depletion mode NMOS |
| 5 | Standard threshold voltage NMOS | Low threshold voltage NMOS |

Standard threshold voltage NMOS transistors have a threshold voltage of about +0.7 volts. Low threshold voltage NMOS transistors have a threshold voltage of about +0.45 volts. Natural threshold voltage NMOS transistors have a threshold voltage of about −60 millivolts. Depletion mode NMOS transistors have a threshold voltage of about −600 millivolts.

In each example of Table 1, the threshold voltage of the transistor 108 is lower than the threshold voltage of the transistor 106. The difference in the threshold of the transistor 106 and the threshold of the transistor 108 defines the offset voltage (the reference voltage) that sets the trip voltage of the comparator 102. With the transistors 106 and 108 in sub-threshold: the currents in the transistors 106 and 108 are approximately equal at the trip point of the comparator 102; the n factors are approximately the same for the transistors 106 and 108, and the difference in the thresholds is expressed as:

$$VT_{gap} = Vth_{NCH_{LVT}} - Vth_{NCH_{NAT}} + nVt * \ln\left(\frac{\beta eff_{NCH_{NAT}}}{\beta eff_{NCH_{LVT}}}\right) \tag{2}$$

where:

$Vth_{NCH_{LVT}}$ is the threshold voltage of the transistor 106;

$Vth_{NCH_{NAT}}$ Is the threshold voltage of the transistor 108;

n is the sub-threshold slope factor of the transistor 106 and the transistor 108, given as:

$$n = \frac{C_{ox} + C_{dep}}{C_{ox}} = 1 + \frac{C_{dep}}{C_{ox}}$$

where $C_{dep}$, is the depletion layer capacitance and $C_{ox}$ is the oxide capacitance per unit area;

Vt is thermal voltage defined by $$\frac{kT}{q},$$

where k is Boltzmann's constant, T is temperature, and q is the electronic charge;

$\beta eff_{NCH}$ and $\beta eff_{NCH_{NAT}}$ are the effective betas of the transistor 106 and the transistor 108 using actual width and length of the transistors in operation, and equals (as a first approximation)

$$\mu_{eff} C_{ox}\left(\frac{W_{eff}}{L_{eff}}\right),$$

where:

$\mu_{eff}$ is the effective mobility;

$W_{eff}$ is effective width; and $L_{eff}$ is effective length;

$Vth_{NCH_{LVT}}-Vth_{NCH_{NAT}}$ is the threshold voltage gap term of equation (2); and $$nVt*\ln\left(\frac{\beta eff_{NCH_{NAT}}}{\beta eff_{NCH_{LVT}}}\right)$$

is the temperature coefficient correction term of equation (2).

Figure 2:
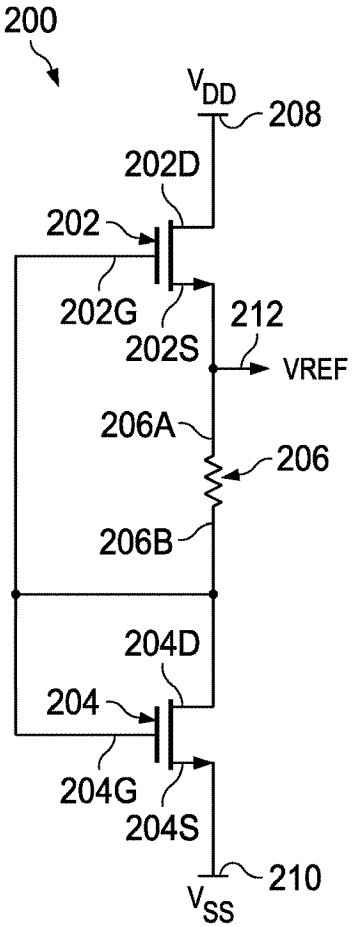
FIG. 2 shows an example reference voltage circuit that generates a reference voltage based on a difference of threshold voltage of two transistors.

The trip voltage of the comparator 102 is the voltage across the input terminals 102A and 102B of the comparator 102 at which the output terminal 102C of the comparator 102 changes state. The trip voltage of the comparator 102 is expressed as:

$$V_{trip}=\frac{VT_{gap}(RA_{TOP}+RA_{BOT})}{RA_{BOT}} \tag{3}$$

where:

$RA_{TOP}$ is the resistance of the resistor 122; and $RA_{BOT}$ is the resistance of the variable resistor 124; and FIG. 2 shows an example reference voltage circuit 200 that generates a reference voltage based on a difference of threshold voltage of two transistors. The reference voltage circuit 200 includes a transistor 202, a transistor 204, and a resistor 206. A drain terminal 202D of the transistor 202 is coupled to a power supply terminal 208, and a source terminal 202S of the transistor 202 is coupled to a reference voltage output terminal 212 and a terminal 206A of the resistor 206.

A drain terminal 204D of the transistor 204 is coupled to a terminal 206B of the resistor 206, and a source terminal 204S of the transistor 204 is coupled to a reference voltage terminal 210 (e.g., ground terminal). A gate terminal 204G of the transistor 204 is coupled to the drain terminal 204D of the transistor 204, and to a gate terminal 202G of the transistor 202.

The reference voltage (VREF) provided at the reference voltage output terminal 212 is defined as:

$$V_{ref}=VT_{gap} \tag{4}$$

where $VT_{gap}$ is as defined in equation (2).

Many applications require that electronic circuits, such as the power supply voltage supervisor circuit 100 and the reference voltage circuit 200, have low temperature drift. However, the threshold voltage Vth of MOSFETs is not modelled as accurately as the base-emitter voltage (VBE) of a bipolar junction transistor. More specifically, modelled temperature coefficient of Vth may not closely match that of a silicon device. The power supply voltage supervisor circuit 100 and the reference voltage circuit 200 cannot be trimmed for temperature drift, which reduces the accuracy of reference voltages generated by the circuits.

The electronic circuits described herein include trim circuitry to correct for temperature coefficient modelling inaccuracy and improve temperature drift. The trim circuitry allows for adjustment of first order temperature drift in VTgap voltage, and provides linear temperature coefficient adjustment steps.

Figure 3A:
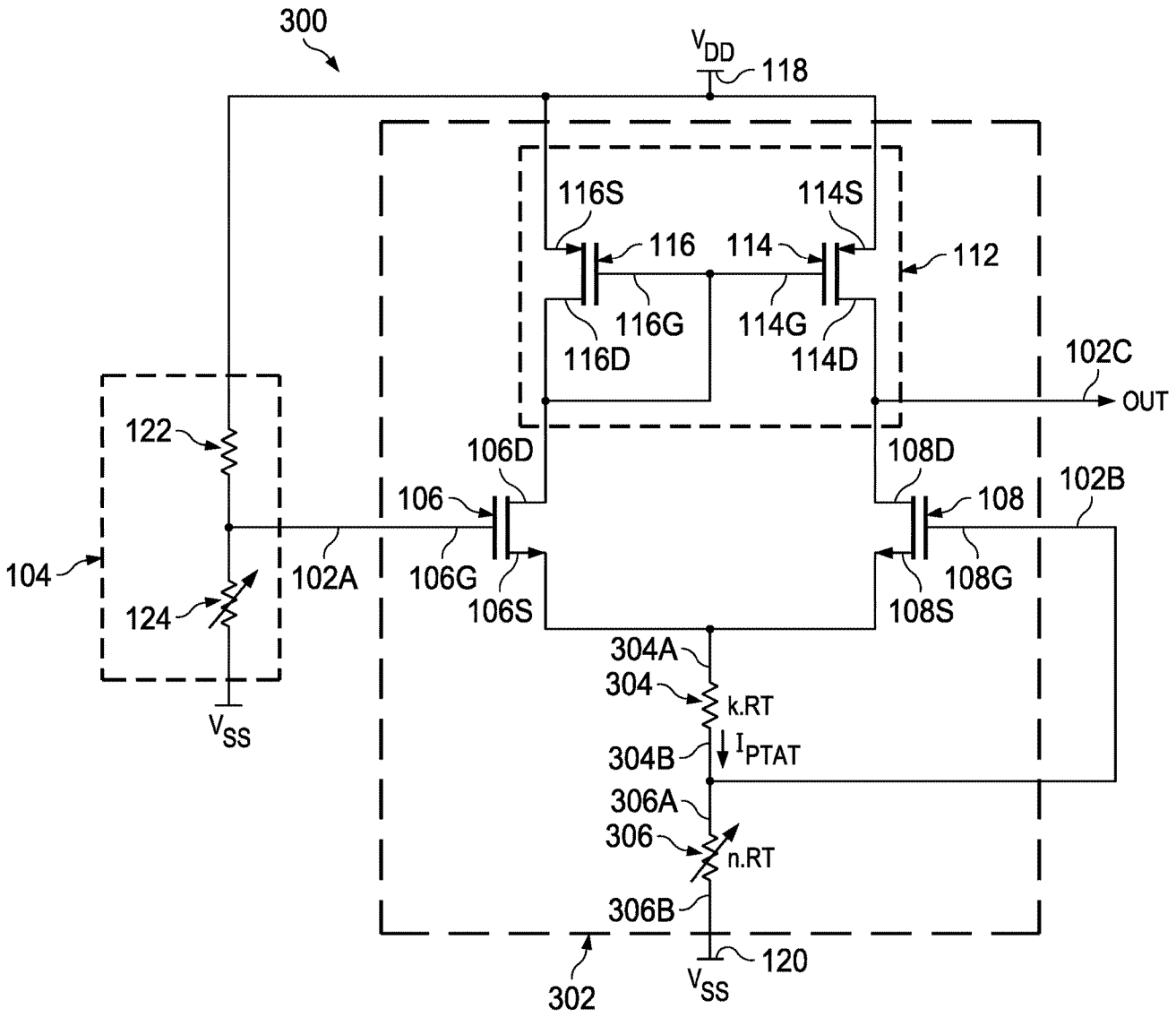
FIGS. 3A and 3B shows an example voltage supervisor circuit that includes a trip point based on a difference of threshold voltages of two transistors, and temperature coefficient trim circuitry.

FIG. 3A shows an example power supply voltage supervisor circuit 300 that includes a trip point based on a difference of threshold voltage of two transistors and includes temperature coefficient trim circuitry. The power supply voltage supervisor circuit 300 is similar to the power supply voltage supervisor circuit 100. The comparator 302 of the power supply voltage supervisor circuit 300 includes a fixed resistor 304 and a variable resistor 306 in place of the current source 110 of the comparator 102. A terminal 304A of the fixed resistor 304 is coupled to the source terminal 106S of the transistor 106 and the source terminal 108S of the transistor 108. A terminal 304B of the fixed resistor 304 is coupled to the input terminal 102B of the comparator 302 (the gate terminal 108G of the transistor 108). The terminal 306A of the variable resistor 306 is coupled to the terminal 304B of the fixed resistor 304, and the terminal 306B of the variable resistor 306 is coupled to the reference voltage terminal 120.

The variable resistor 306 may be implemented as resistor ladder that includes a plurality of resistors connected in series. The resistance of the variable resistor 306 is adjustable to change the temperature coefficient of the comparator 302. The variable resistor 306 adds a proportional to absolute temperature (PTAT) term for trimming the temperature coefficient of the comparator 302. The added temperature coefficient trim term is voltage across the variable resistor 306. The voltage across the variable resistor 306 is:

$$I_{PTAT}*n.RT \tag{5}$$

where:

$I_{PTAT}$ is current proportional to absolute temperature; and n.RT is resistance of the variable resistor 306.

With the transistor 108 in weak inversion:

$$I_{PTAT}=\frac{VGS_{NCH_{NAT}}}{k\cdot RT}\sim\frac{Vth_{NCH_{NAT}}}{k\cdot RT}, \tag{6}$$

and the voltage across the variable resistor 306 is:

$$\frac{n*Vth_{NCH_{NAT}}}{k}. \tag{7}$$

where:

k is a total number of resistors having a same value connected in series in the variable resistor 306; and n is the number of the resistors between a tap point selected to trim the temperature coefficient and the reference voltage terminal 120.

The difference in the thresholds of the transistor 106 and the transistor 108 ($VT_{gap}$) is expressed as:

$$VT_{gap}=Vth_{NCH_{LVT}}+Vth_{NCH_{NAT}}+nVt*\ln\left(\frac{\beta eff_{NCH_{NAT}}}{\beta eff_{NCH_{LVT}}}\right)+\frac{n*|Vth_{NCH_{NAT}}|}{k} \tag{8}$$

where:

$$\frac{n*|Vth_{NCH_{NAT}}|}{k}$$

is the temperature coefficient trim term added by the variable resistor 306.

Figure 3B:
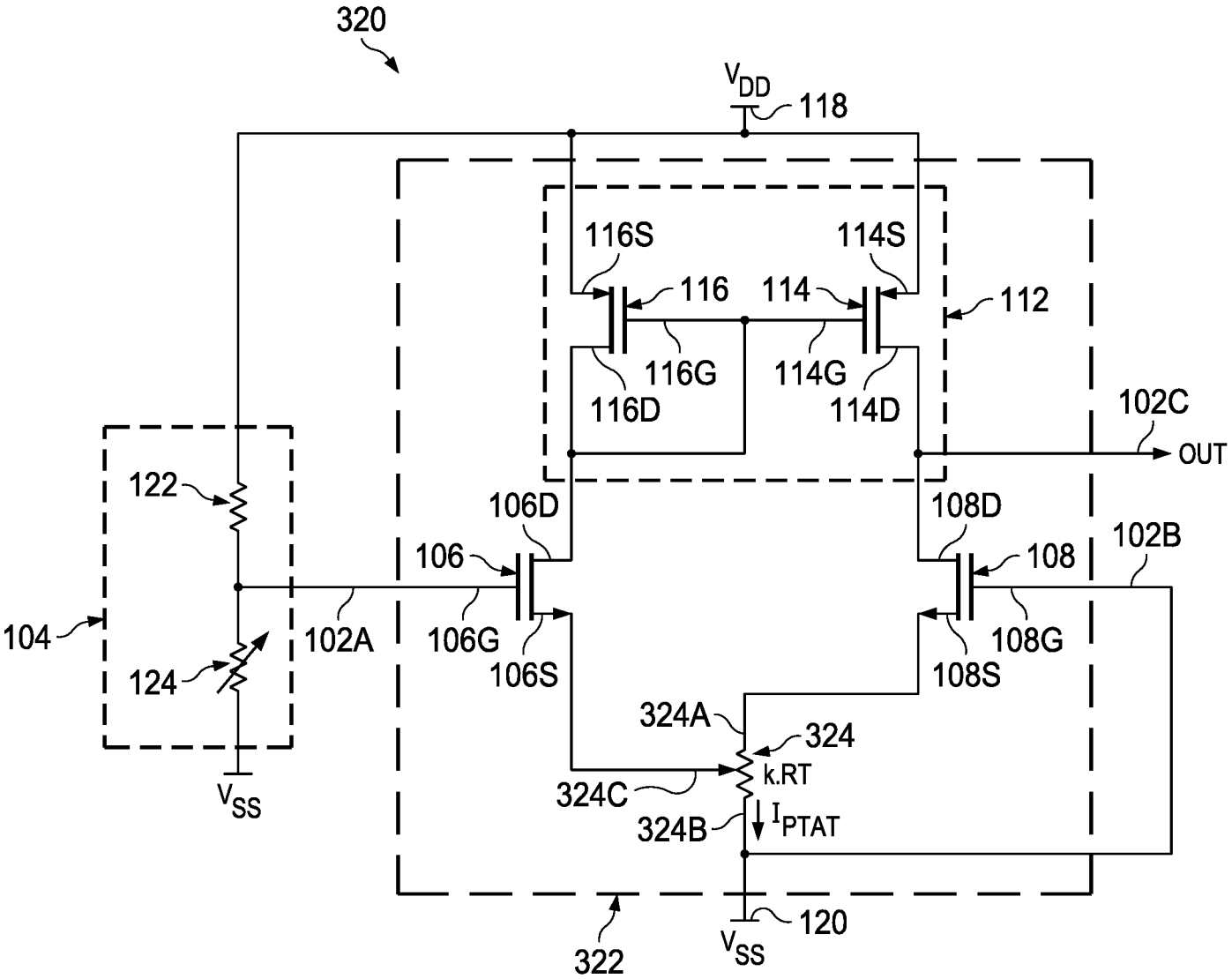

FIG. 3B shows an example power supply voltage supervisor circuit 320 that includes a trip point based on a difference of threshold voltage of two transistors and includes temperature coefficient trim circuitry. The power supply voltage supervisor circuit 320 is similar to the power supply voltage supervisor circuit 300. The comparator 322 of the power supply voltage supervisor circuit 320 includes a variable resistor 324 in place of the fixed resistor 304 and the variable resistor 306 of the comparator 302. A terminal 324A of the variable resistor 324 is coupled to the source terminal 108S of the transistor 108. A terminal 324B of the variable resistor 324 is coupled to the reference voltage terminal 120. The terminal 324C of the variable resistor 324 is coupled to the source terminal 306S of the transistor 106S.

Similar to the variable resistor 306 of comparator 302, the variable resistor 324 may be implemented as a resistor ladder that includes a plurality of resistors connected in series, and the resistance of the variable resistor 324 is adjustable to change the temperature coefficient of the comparator 322. The variable resistor 324 adds a proportional to absolute temperature (PTAT) term for trimming the temperature coefficient of the comparator 322.

Figure 4:
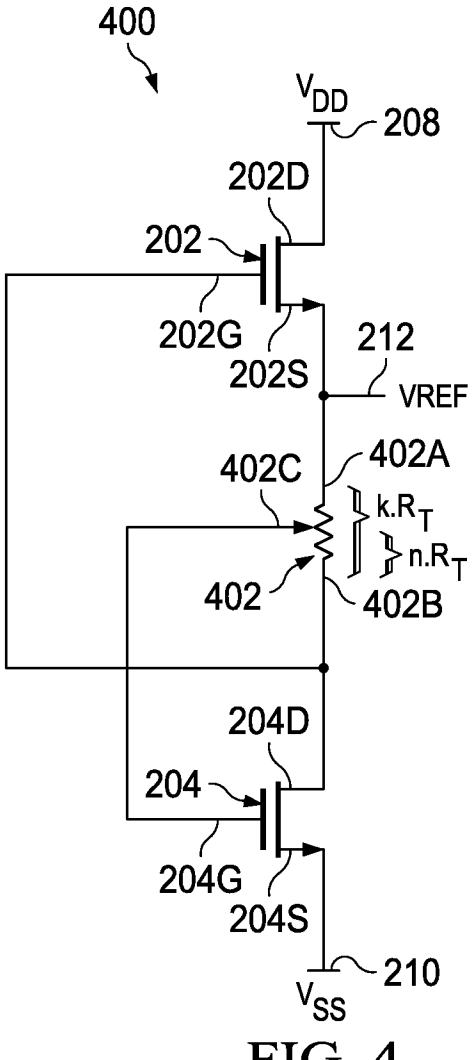

FIG. 4 shows an example reference voltage circuit 400 that generates a reference voltage based on a difference of threshold voltage of two transistors and includes temperature coefficient trim. The reference voltage circuit 400 is similar to the reference voltage circuit 200, and includes a variable resistor 402. A terminal 402A of the variable resistor 402 is coupled to the source terminal 202S of the transistor 202 and the reference voltage output terminal 212. A terminal 402B of the variable resistor 402 is coupled to the drain terminal 204D of the transistor 204. A terminal 402C of the variable resistor 402 is coupled to the 204G of the transistor 204. The tap point of the 402 is changed to adjust the temperature coefficient of the reference voltage circuit 400.

Figure 5:
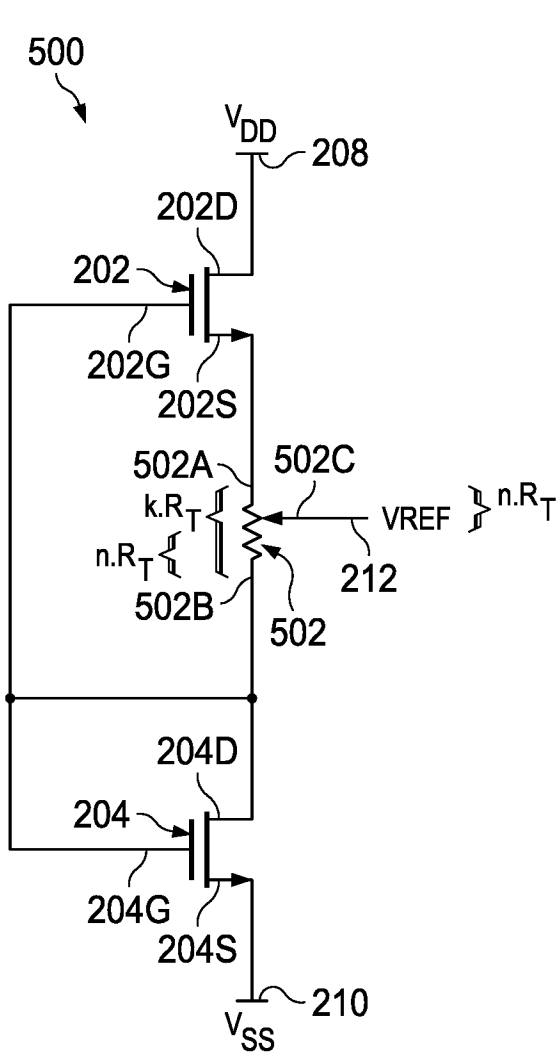
FIGS. 4 and 5 show example reference voltage circuits that generate a reference voltage based on a difference of threshold voltages of two transistors, and include temperature coefficient trim circuitry.

FIG. 5 shows another example reference voltage circuit 500 that generates a reference voltage based on a difference of threshold voltage of two transistors and includes temperature coefficient trim. The reference voltage circuit 500 is similar to the reference voltage circuit 200, and includes a variable resistor 502. A terminal 502A of the variable resistor 502 is coupled to the source terminal 202S of the transistor 202. A terminal 502B of the variable resistor 502 is coupled to the drain terminal 204D of the transistor 204. A terminal 502C of the variable resistor 502 is coupled to the reference voltage output terminal 212. The tap point of the 502 is changed to adjust the temperature coefficient of the reference voltage circuit 500.

In the reference voltage circuit 400 and the reference voltage circuit 500, the reference voltage provided at the reference voltage output terminal 212 is expressed as:

$$VREF = Vth_{NCH_{LVT}} + |Vth_{NCH_{NAT}}| + nVt * \ln\left(\frac{\beta eff_{NCH_{NAT}}}{\beta eff_{NCH_{LVT}}}\right) - \frac{n * |Vth_{NCH_{NAT}}|}{k}. \quad (9)$$

Figure 6:
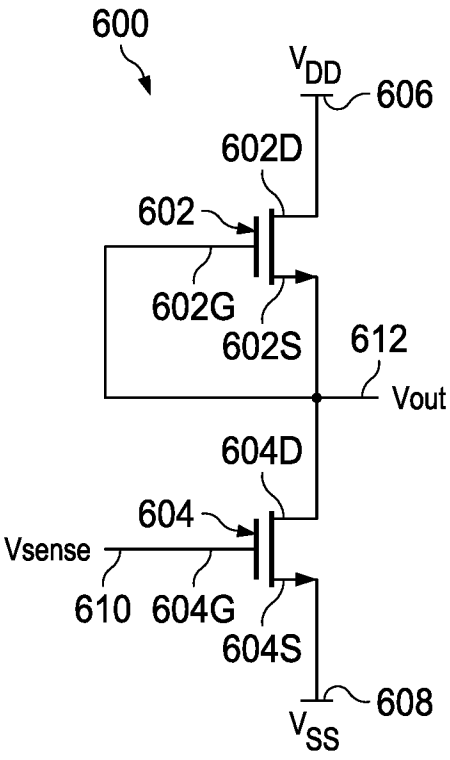
FIG. 6 shows an example power supply voltage supervisor circuit that includes a trip point based on a difference of threshold voltages of two transistors.

FIG. 6 shows an example power supply voltage supervisor circuit 600 that includes a trip point based on a difference of threshold voltage of two transistors. The power supply voltage supervisor circuit 600 includes a transistor 602 and a transistor 604. The transistor 602 is a natural N-channel MOSFET. The transistor 604 is a low threshold voltage N-channel MOSFET. The power supply voltage supervisor circuit 600 is small and provides a status signal at the output terminal 612 with a relatively low power supply voltage of about 0.7 volts. However, quiescent current varies greatly (about 400×) in the power supply voltage supervisor circuit 600, and the power supply voltage supervisor circuit 600 lacks accuracy trim, threshold adjustment, and temperature coefficient trim.

The transistor 602 includes a drain terminal 602D coupled to a power supply terminal 606, a source terminal 602S coupled to the output terminal 612, and a gate terminal 602G coupled to the output terminal 612. The transistor 604 includes a drain terminal 604D coupled to the source terminal 602S of the transistor 602, a source terminal 604S coupled to a reference voltage terminal 608 (e.g., a ground terminal), and a gate terminal 604G coupled to a sense voltage terminal 610. The voltage (Vsense) at the sense voltage terminal 610 is the voltage monitored by the power supply voltage supervisor circuit 600. The voltage at the output terminal 612 transitions as Vsense changes relative to the trip voltage of the power supply voltage supervisor circuit 600. The trip voltage is defined as per the threshold voltage gap of equation (2).

Figure 7:
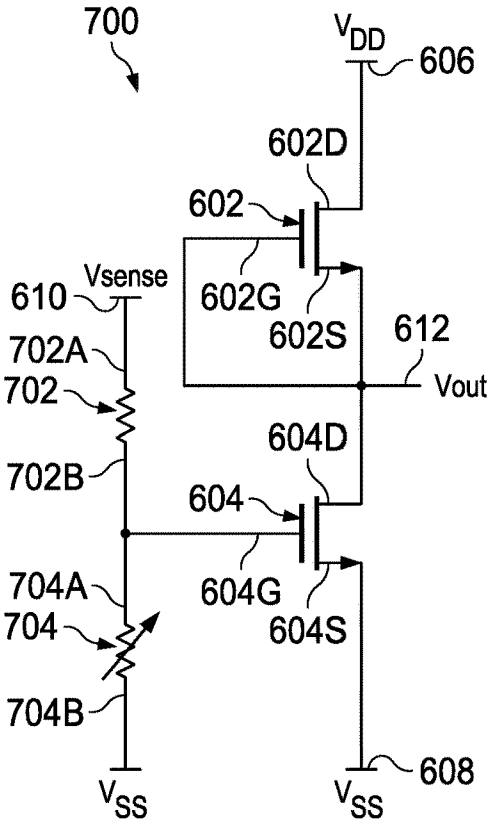
FIG. 7 shows an example power supply voltage supervisor circuit that includes a trip point based on a difference of threshold voltages of two transistors and includes accuracy trim circuitry.

FIG. 7 shows an example power supply voltage supervisor circuit 700 that is similar to the power supply voltage supervisor circuit 600, includes accuracy trim circuitry. The accuracy trim circuitry includes a fixed resistor 702 and a variable resistor 704. The fixed resistor 702 includes a terminal 702A coupled to the sense voltage terminal 610, and a terminal 702B coupled to the gate terminal 604G of the transistor 604. The variable resistor 704 includes a terminal 704A coupled to the terminal 702B of the fixed resistor 702, and a terminal 704B coupled to the reference voltage terminal 608. The resistance of the variable resistor 704 is adjusted to change the sense voltage provided at the gate terminal 604G of the transistor 604 and trim the accuracy and threshold of the power supply voltage supervisor circuit 700. The voltage at the gate terminal 604G of the transistor 604 is the voltage monitored by the power supply voltage supervisor circuit 700. The voltage at the output terminal 612 transitions as the voltage at the gate terminal 604G of the transistor 604 changes relative to the trip voltage of the power supply voltage supervisor circuit 700. The trip voltage is defined as per the threshold voltage gap of equation (3) where the resistance of the resistor 702 is $RA_{TOP}$ and the resistance of the variable resistor 704 is $RA_{BOT}$. Like the power supply voltage supervisor circuit 600, the power supply voltage supervisor circuit 700 operates with a relatively low power supply voltage of about 0.7 volts, but quiescent current varies greatly (about 400×), and the power supply voltage supervisor circuit 700 lacks threshold adjustment and temperature coefficient trim.

Figure 8:
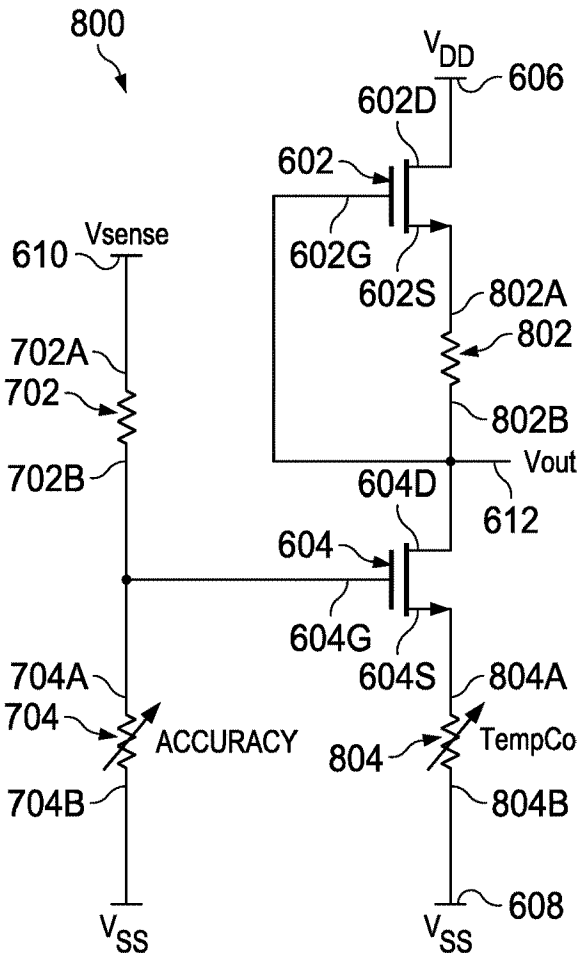
FIG. 8 shows an example power supply voltage supervisor circuit that includes a trip point based on a difference of threshold voltage of two transistors, accuracy trim circuitry, and temperature coefficient trim circuitry.

FIG. 8 shows an example power supply voltage supervisor circuit 800 that is similar to the power supply voltage supervisor circuit 700 and includes temperature coefficient trim circuitry. The temperature trim circuitry includes a fixed resistor 802 and a variable resistor 804. The fixed resistor 802 includes a terminal 802A coupled to the source terminal 602S of the transistor 602, and a terminal 802B coupled to the output terminal 612 and the gate terminal 602G of the transistor 602. The variable resistor 804 includes a terminal 804A coupled to the source terminal 604S of the transistor 604, and a terminal 804B coupled to the reference voltage terminal 608. The resistance of the variable resistor 804 is adjusted to change the temperature coefficient of the power supply voltage supervisor circuit 800. The power supply voltage supervisor circuit 800 provides accuracy trim, adjustable threshold, temperature coefficient trim, and reduced quiescent current variation. The power supply voltage needed to operate the power supply voltage supervisor circuit 800 is higher than that of the power supply voltage supervisor circuit 700.

Figure 9:
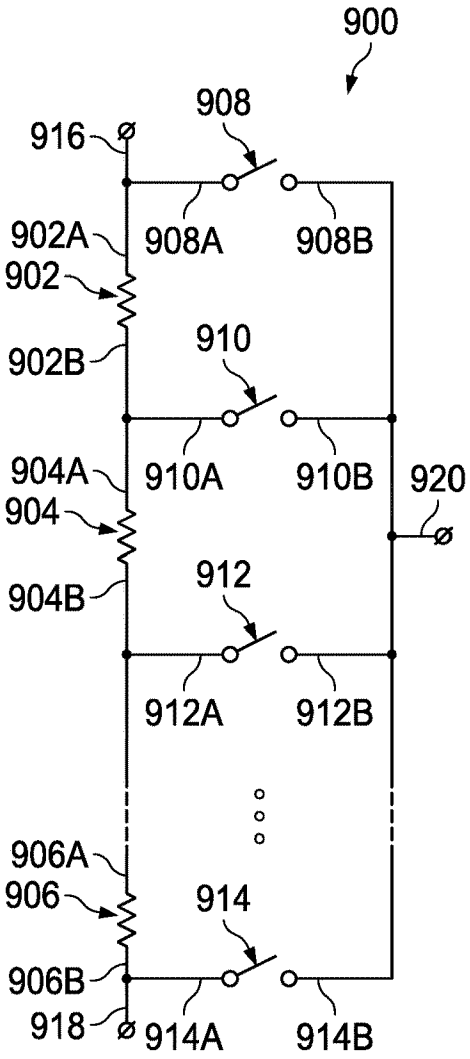
FIG. 9 shows a block diagram for a variable resistor suitable for use in temperature coefficient trim of electronic circuits that produce a reference voltage based on a difference of threshold voltages of two transistors.

FIG. 9 shows a block diagram for a variable resistor 900 suitable for use in temperature coefficient trim of electronic circuits that produce a reference voltage based on a difference of threshold voltage of two transistors. The variable resistor 900 is an implementation of the variable resistor 306, the variable resistor 402, the variable resistor 502, or the variable resistor 804. The variable resistor 900 includes a terminal 916, a terminal 918, a terminal 920, a resistor 902, a resistor 904, a resistor 906, a switch 908, a switch 910, a switch 912, and a switch 914. In practice the variable resistor 900 may include any number of resistors and any number of switches. For example, an implementation of the variable resistor 900 may include 32 resistors connected in series and 33 switches coupled to the resistors. The resistors 902, 904, and 906 are connected in series. The terminal 902A of the resistor 902 is coupled to the terminal 916, and the terminal 902B of the resistor 902 is coupled to the terminal 904A of the resistor 904. The terminal 904B of the resistor 904 is coupled to the terminal 906A of the resistor 906 via any number of additional resistors. The terminal 906B of the resistor 906 is coupled to the terminal 918.

Each of the switches includes a terminal coupled to the terminal 920 and a terminal coupled to the resistors. The switch 908 includes a terminal 908A coupled to the terminal 902A of the resistor 902 and a terminal 908B coupled to the terminal 920. The switch 910 includes a terminal 910A coupled to the terminal 904A of the resistor 904 and a terminal 910B coupled to the terminal 920. The switch 912 includes a terminal 912A coupled to the terminal 904B of the resistor 904 and a terminal 912B coupled to the terminal 920. The switch 914 includes a terminal 914A coupled to the terminal 906B of the resistor 906 and a terminal 914B coupled to the terminal 920.

In the power supply voltage supervisor circuit 300, the reference voltage circuit 400, the reference voltage circuit 500, or the power supply voltage supervisor circuit 800, a switch of the variable resistor 900 may be selected as part of a temperature coefficient trim procedure.

Figure 10:
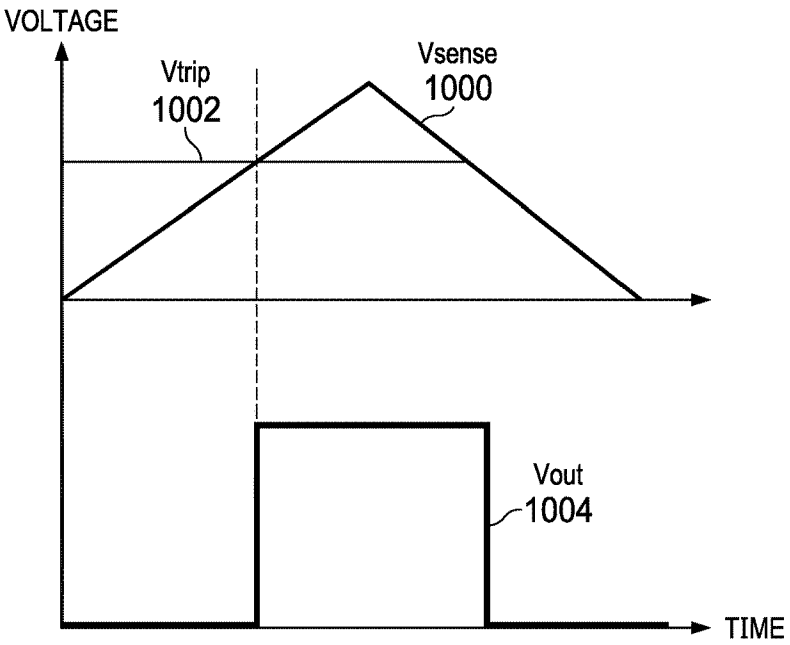
FIG. 10 illustrates operation of a power supply voltage supervisor circuit.

FIG. 10 illustrates operation of the power supply voltage supervisor circuit 300, the power supply voltage supervisor circuit 320, the power supply voltage supervisor circuit 600, the power supply voltage supervisor circuit 700, or the power supply voltage supervisor circuit 800. When voltage Vsense 1000 is less than trip voltage Vtrip 1002, the output voltage Vout 1004 of the power supply voltage supervisor circuit 300, the power supply voltage supervisor circuit 320, the power supply voltage supervisor circuit 600, the power supply voltage supervisor circuit 700, or the power supply voltage supervisor circuit 800 is a first voltage level (e.g., a logic low level). When voltage Vsense 1000 is greater than trip voltage Vtrip 1002, the output voltage Vout 1004 of the power supply voltage supervisor circuit 300, the power supply voltage supervisor circuit 320, the power supply voltage supervisor circuit 600, the power supply voltage supervisor circuit 700, or the power supply voltage supervisor circuit 800 is a second voltage level (e.g., a logic high level).

Figure 12:
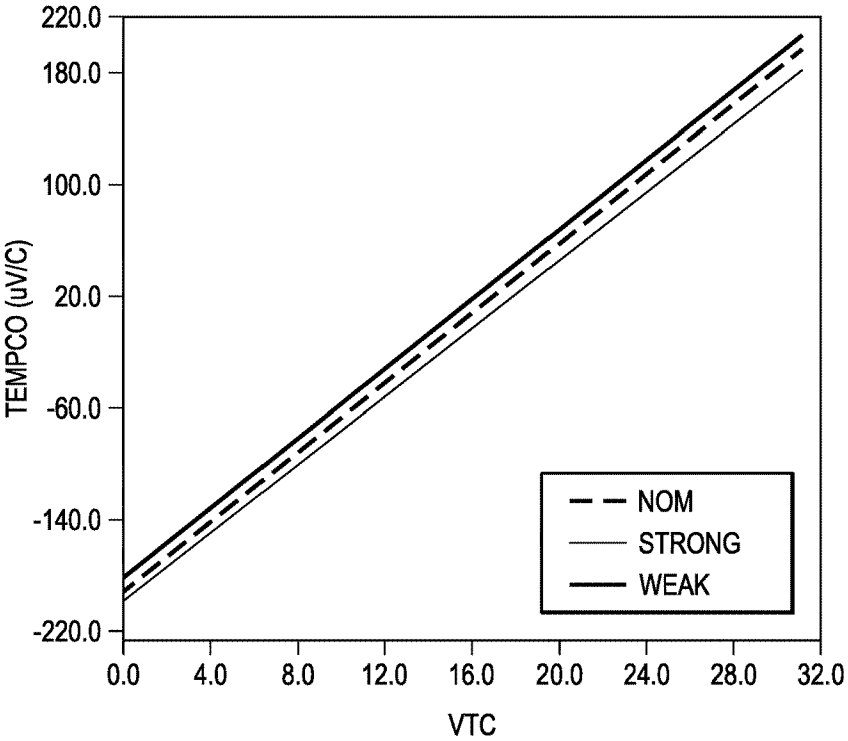
FIG. 12 shows temperature coefficient versus trim code for examples of the electronic circuits described herein.
Figure 11:
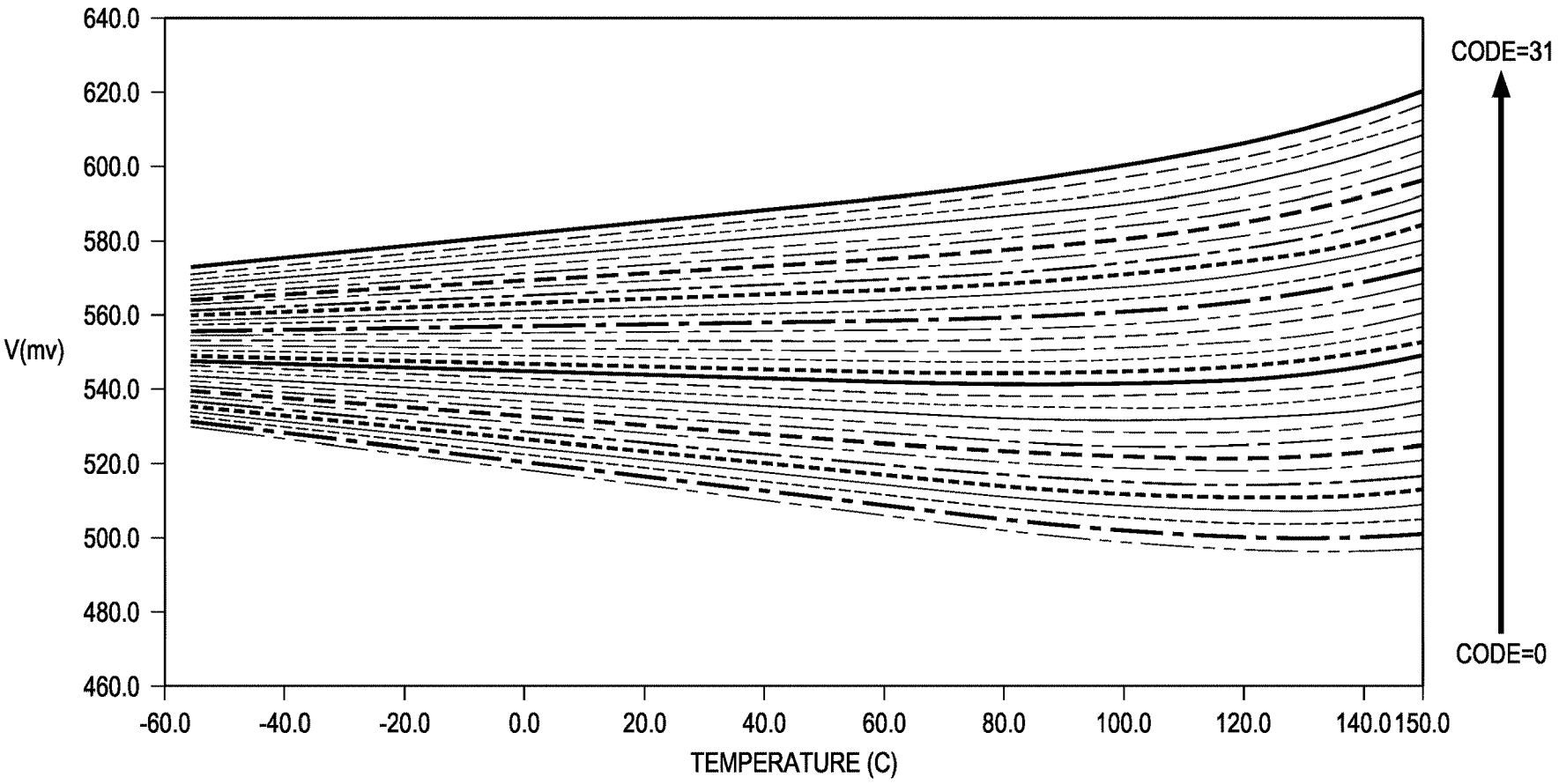
FIG. 11 shows range of temperature coefficient trim provided in the electronic circuits described herein.

FIG. 11 shows the reference voltages generated in one of the circuits described herein (e.g., the power supply voltage supervisor circuit 300, the reference voltage circuit 400, the reference voltage circuit 500, or the power supply voltage supervisor circuit 800) over temperature (−55° to +150° Celsius) with each of 32 different temperature coefficient trim values. Each of the 32 different trim values selects a different resistance of the variable resistor that provides temperature coefficient trim FIG. 12 shows the first order temperature coefficient of VREF for weak, nominal, and strong process versus temperature coefficient trim code (e.g., trim codes 0-31) for examples of the electronic circuits described herein.

Modifications are possible in the described embodiments, and other embodiments are possible, within the scope of the claims.

What is claimed is:

1. An electronic circuit, comprising:
- a comparator circuit, comprising:
  - a first input;
  - a second input;
  - a reference voltage input;
  - a first transistor having a first threshold voltage, and comprising:
    - a first terminal coupled to the first input; and
    - a second terminal;
  - a second transistor having a second threshold voltage different from the first threshold voltage, and comprising:
    - a first terminal coupled to the second input; and
    - a second terminal coupled to the second terminal of the first transistor; and
  - a variable resistor coupled to the first terminal of the second transistor, the second terminal of the second transistor, the second terminal of the first transistor, and the reference voltage input.

2. The electronic circuit of claim 1, wherein the variable resistor comprises:
- a first terminal coupled to the reference voltage input; and
- a second terminal coupled to the second terminal of the first transistor, the second terminal of the second transistor, and the first terminal of the second transistor.

3. The electronic circuit of claim 2, further comprising:
- a fixed resistor comprising:
  - a first terminal coupled to the second terminal of the second transistor; and
  - a second terminal coupled to the second terminal of the variable resistor.

4. The electronic circuit of claim 1, wherein the variable resistor comprises:
- a first terminal coupled to the reference voltage input;
- a second terminal coupled to the second terminal of second transistor; and
- a third terminal coupled to the second terminal of the first transistor.

5. The electronic circuit of claim 1, wherein:
- the first transistor comprises a third terminal;
- the second transistor comprises a third terminal; and
- the comparator circuit further comprises:
  - a current mirror circuit comprising:
    - a diode-connected transistor comprising:
      - a first terminal coupled to a power supply input;
      - a second terminal coupled to the third terminal of the first transistor; and
      - a third terminal coupled to the third terminal of the first transistor; and
    - a third transistor comprising:
      - a first terminal coupled to the power supply input;
      - a second terminal coupled to the third terminal of the second transistor; and
      - a third terminal coupled to the third terminal of the diode-connected transistor.

6. The electronic circuit of claim 1, wherein:
the variable resistor is a first variable resistor; and
the electronic circuit further comprises:
a second variable resistor, comprising:
a first terminal coupled to the reference voltage input; and
a second terminal coupled to the first terminal of the first transistor; and
a fixed resistor comprising:
a first terminal coupled to the first terminal of the first transistor; and
a second terminal coupled to a power supply input.

7. The electronic circuit of claim 1, wherein a trip point of the comparator circuit is based on a difference of the first threshold voltage and the second threshold voltage.

8. An electronic circuit, comprising
a power supply input;
a reference voltage input;
a first transistor having a first threshold voltage, and comprising:
a first terminal coupled to the power supply input; and
a second terminal; and
a second transistor having a second threshold voltage different from the first threshold voltage, and comprising:
a first terminal; and
a second terminal coupled to the reference voltage input; and
a variable resistor comprising:
a first terminal coupled to the second terminal of the first transistor; and
a second terminal coupled to the first terminal of the second transistor.

9. The electronic circuit of claim 8, wherein the first transistor comprises a third terminal coupled to the first terminal of the second transistor.

10. The electronic circuit of claim 8, wherein:
the second transistor comprises a third terminal; and
the variable resistor comprises a third terminal coupled to the third terminal of the second transistor.

11. The electronic circuit of claim 8, further comprising a reference voltage output coupled to the second terminal of the first transistor.

12. The electronic circuit of claim 8, wherein:
the second transistor comprises a third terminal coupled to the second terminal of the variable resistor.

13. The electronic circuit of claim 8, wherein the first transistor comprises a third terminal coupled to the second terminal of the variable resistor.

14. The electronic circuit of claim 8, wherein:
the variable resistor comprises a third terminal; and
the electronic circuit comprises a reference voltage output coupled to the third terminal of the variable resistor.

15. An electronic circuit, comprising:
a first transistor having a first threshold voltage, and comprising:
a first terminal coupled to a power supply input;
a second terminal; and
a third terminal;
a second transistor having a second threshold voltage different from the first threshold voltage, and comprising:
a first terminal coupled to the second terminal of the first transistor and the third terminal of the first transistor; and
a second terminal; and
a variable resistor comprising:
a first terminal coupled to the second terminal of the second transistor; and
a second terminal coupled to a reference voltage input.

16. The electronic circuit of claim 15, further comprising:
a fixed resistor comprising:
a first terminal coupled to the second terminal of the first transistor; and
a second terminal coupled to the first terminal of the second transistor.

17. The electronic circuit of claim 15, further comprising:
a sense voltage input; and
a fixed resistor comprising:
a first terminal coupled to the sense voltage input; and
a second terminal coupled to the second terminal of the second transistor.

18. The electronic circuit of claim 15, wherein:
the variable resistor is a first variable resistor;
the second transistor comprises a third terminal; and
the electronic circuit further comprises:
a second variable resistor, comprising:
a first terminal coupled to the third terminal of the second transistor; and
a second terminal coupled to the reference voltage input.

19. An electronic circuit, comprising:
a first transistor having a first threshold voltage;
a second transistor having a second threshold voltage different from the first threshold voltage, and coupled to the first transistor; and
a variable resistor coupled to the first transistor and the second transistor, and configured to adjust a temperature coefficient of the electronic circuit;
wherein the electronic circuit is configured to generate a reference voltage based on a difference of the first threshold voltage and the second threshold voltage.

20. The electronic circuit of claim 19, wherein:
the variable resistor comprises:
a first terminal coupled to a reference voltage input; and
a second terminal;
the electronic circuit further comprises:
a fixed resistor comprising:
a first terminal coupled to the second terminal of the variable resistor; and
a second terminal;
the first transistor comprises a source coupled to the second terminal of the fixed resistor; and
the second transistor comprises:
a source coupled to the second terminal of the fixed resistor; and
a gate coupled to the first terminal of the fixed resistor.

21. The electronic circuit of claim 19, wherein:
the variable resistor comprises:
a first terminal;
a second terminal; and
a third terminal;
the first transistor comprises:
a source coupled to the first terminal of the variable resistor; and
a gate coupled to the second terminal of the variable resistor; and
the second transistor comprises:
a drain coupled to the second terminal of the variable resistor; and
a gate coupled to the third terminal of the variable resistor.

22. The electronic circuit of claim 19, wherein:
the variable resistor comprises:
a first terminal;
a second terminal; and
a third terminal;
the first transistor comprises:
a source coupled to the first terminal of the variable resistor; and
a gate coupled to the second terminal of the variable resistor;
the second transistor comprises:
a drain coupled to the second terminal of the variable resistor; and
a gate coupled to the second terminal of the variable resistor; and
the electronic circuit comprises a reference voltage output coupled to the third terminal of the variable resistor.

23. The electronic circuit of claim 19, wherein:
the electronic circuit further comprises:
a fixed resistor, comprising:
a first terminal; and
a second terminal; and
a reference voltage output;
the variable resistor comprises:
a first terminal; and
a second terminal coupled to a reference voltage input;
the first transistor comprises:
a source coupled to the first terminal of the fixed resistor; and
a gate coupled to the second terminal of the fixed resistor; and
the second transistor comprises:
a drain coupled to the second terminal of the fixed resistor and the reference voltage output; and
a source coupled to the first terminal of the variable resistor.

24. The electronic circuit of claim 19, wherein:
the variable resistor comprises:
a first terminal,
a second terminal; and
a third terminal coupled to a reference voltage input;
the first transistor comprises a first terminal coupled to the first terminal of the variable resistor; and
the second transistor comprises:
a source coupled to the second terminal of the variable resistor; and
a gate coupled to the third terminal of the variable resistor.

* * * * *